United States Patent [19]

Montrose

[11] 3,972,562

[45] Aug. 3, 1976

[54] COLLAPSIBLE FURNITURE

[75] Inventor: Bjorne Thorwald Montrose, Leigh-on-Sea, England

[73] Assignees: M. Rosenberg-Bischoff; Jean Bischoff

[22] Filed: Sept. 26, 1974

[21] Appl. No.: 509,500

[30] Foreign Application Priority Data

Sept. 27, 1973 United Kingdom ..... 45350/73

[52] U.S. Cl. ..... 297/359; 5/37 R; 5/37 C; 5/38; 297/27

[51] Int. Cl.[2] ..... A47C 1/025; A47C 17/16

[58] Field of Search ..... 297/359, 360, 27, 28, 297/115, 118; 5/37, 38, 40

[56] References Cited

UNITED STATES PATENTS

| | | | |
|---|---|---|---|
| 464,153 | 12/1891 | Goldschmidt | 297/110 |
| 746,446 | 12/1903 | Bown | 297/115 |
| 893,095 | 7/1908 | Peterson | 297/359 |
| 898,399 | 9/1908 | Albert | 5/38 |
| 1,232,357 | 9/1917 | Massacese | 5/38 |
| 1,400,718 | 12/1921 | Bittel | 5/38 |
| 2,282,270 | 5/1942 | Vallone | 297/359 |
| 2,679,892 | 6/1954 | Johnson | 297/359 |
| 3,151,342 | 10/1964 | McLean | 297/110 X |

FOREIGN PATENTS OR APPLICATIONS

| | | | |
|---|---|---|---|
| 224,185 | 4/1943 | Switzerland | 297/359 |

*Primary Examiner*—Roy D. Frazier
*Assistant Examiner*—William E. Lyddane
*Attorney, Agent, or Firm*—Young & Thompson

[57] ABSTRACT

The invention relates to a foldable chair having a back support which is pivotally connected to a seat support and arm rests which are pivotally connected to the back support and adapted to be rotated into a position in which they form a ground support for the back support when the latter is in a swung down extended position for forming a bed.

6 Claims, 10 Drawing Figures

COLLAPSIBLE FURNITURE

This invention relates to articles of furniture and is more particularly concerned with foldable seats, chairs and like articles which are intended preferably for occasional use in the house, or for leisure use in a garden, on a beach or other location. Such articles must be of light weight in order that they can be carried and conveyed without great effort, both in the erected and in the folded state; they must be easy to store in a small space, when folded, and should be of simple construction to permit quick erection without the need for great skill.

The invention consists in a foldable chair having a back support which is pivotally connected to a seat support, and arm rests which are pivotally connected to the back support and adapted to be rotated into a position in which they form a ground support for the back support when the latter is in a swung down extended position to form a bed.

Figure 1:
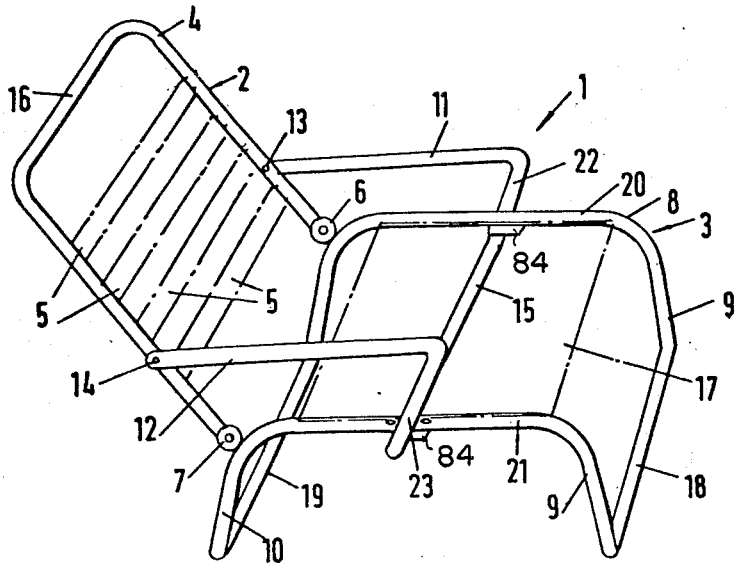
Figure 2:
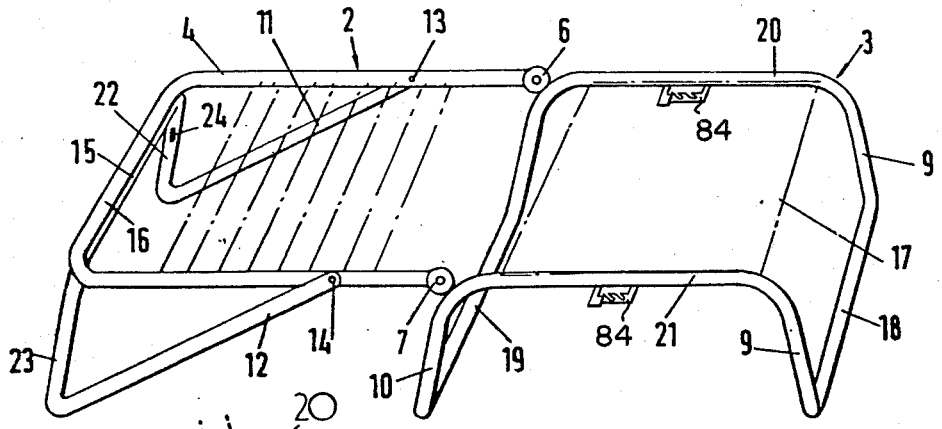
Figure 7B:
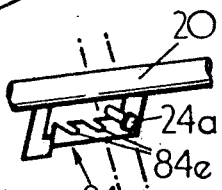
Figure 7A:
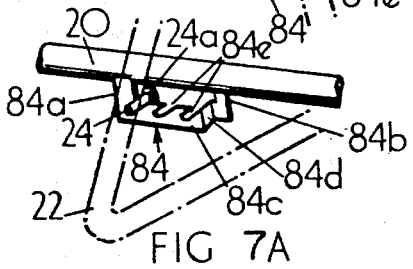
Figure 3A:
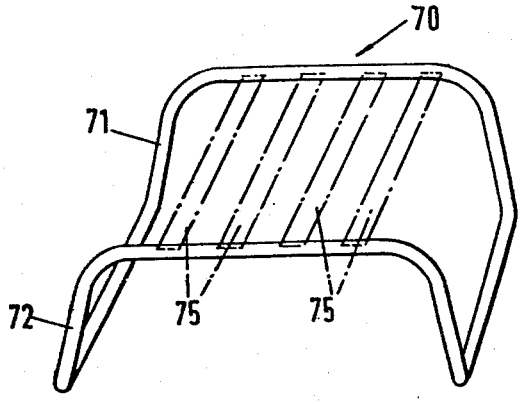
Figure 3B:
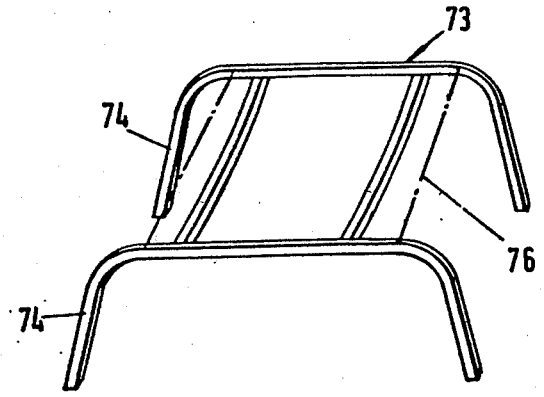
Figure 5:
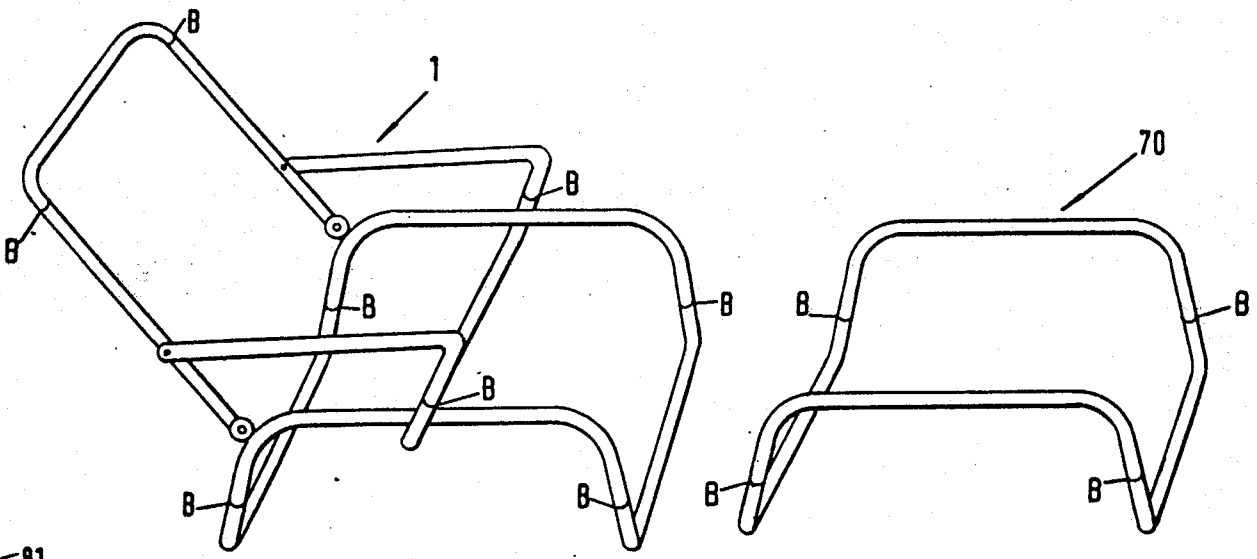
Figure 6:
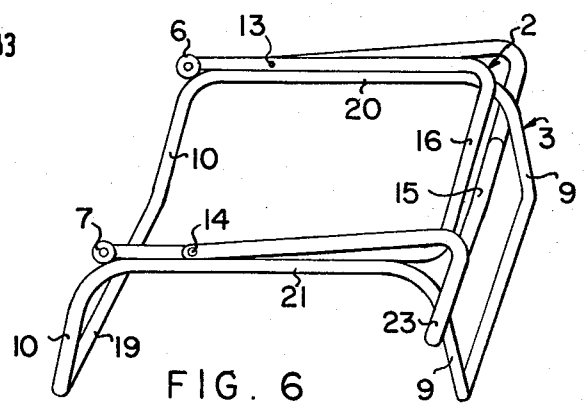
Figure 4A:
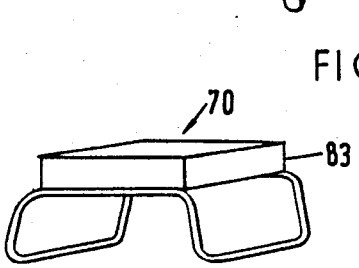
Figure 4B:
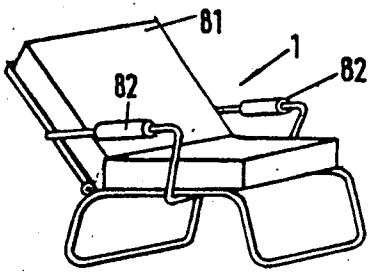
Figure 4B:
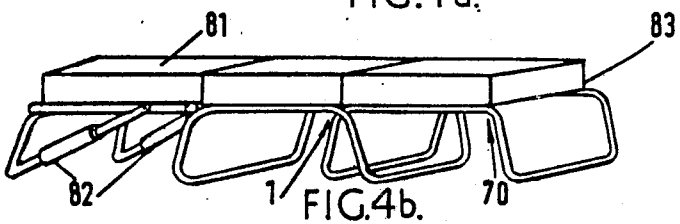

Several embodiments of the invention are described below in detail with reference to the accompanying drawings, in which:

FIG. 1 illustrates diagrammatically a foldable chair constructed in accordance with the invention, FIG. 2 illustrates the chair of FIG. 1 with the back support swung down, FIGS. 3a and 3b illustrate two separate supports, FIGS. 4a and 4b illustrate the chair of FIG. 1 and the separate support of FIG. 3a with mattress and cushions, in two different positions, and FIG. 5 illustrates a modification, FIG. 6 illustrates the chair of FIG. 1 in a folded position, and FIGS. 7a and 7b are two detail views of structure for securing the arm rests in adjusted positions.

FIG. 1 illustrates a chair 1 having a back support 2 and a seat support 3. In the present example the back support comprises a U-shaped frame 4 which is formed from a metal tube having a circular cross-section and which is provided with a support surface constituted by a plurality of resilient rubberised strips 5 which are releasably attached to the limbs of the U-shaped frame by means of hooks engaging into holes in the limbs. Alternatively the support surface may be constituted by a sheet of resilient material secured to the frame in a similar manner.

The frame 4 is rotatably attached by means of pivot joints 6 and 7 to the seat support 3 which comprises a substantially rectangular frame 8 also formed from a metal tube having a circular cross-section. Two opposite end portions 9 and 10 of the frame 8 are bent downwards to constitute, together with the respective transverse members 18 and 19, ground supports for the chair. A seat support surface may be provided by a plurality of resilient strips, as in the case of the back support, but is shown in the Figure merely for the purpose of illustrating the alternative construction referred to above, to consist of a sheet 17 of resilient material releasably attached to the side members 20 and 21 of the frame 8.

Arm rests 11 and 12 are formed by a further generally U-shaped frame of circular cross-section metal tube bent as shown. The free ends 13 and 14 of the arm rest frame are pivotally connected to the frame of the back support, and the transverse portion 15 of the arm rest frame extends, in the illustrated position of the chair, transversely across the seat support at a location below the side members 20 and 21 thereof.

The arm rest frame is arranged to be secured to the seat support in a plurality of selectable positions by means still to be described. Each of these positions controls the angle between the support surface of the back support and the support surface of the seat support. The arm rest frame may also be swung back and the back support swung down into an extended position as illustrated in FIG. 2. In this case the support surfaces of the back support and the seat support are substantially flush with each other, and the arm rest frame forms a ground support for the back support, the transverse portion 15 of the arm rest frame engaging the yoke portion 16 of the U-shaped frame 4.

The chair may be provided with a separate support constructed substantially in the same way as the respective seat support. Thus, a separate support 70 illustrated in FIG. 3a is generally similar to the seat support 3. However downwardly directed end portions 71 and 72 of the separate support 70 are mutually spaced in such manner that they can just enter between the end portions 9 of the chair 1 and form a friction fit therewith. The separate support 70 can thereby be joined to the chair 1 and form an extension thereof when the chair is to be used e.g. as a bed.

Likewise a separate support 73 illustrated in FIG. 3b has 74 arranged to form a friction fit with the feet of the chair when the support 73 is joined to the latter.

Each of the separate supports is provided with a resilient support surface, arranged as described with reference to chair 1. In FIG. 3a the support surface is shown to be constituted by resilient strips 75, whereas the support surface shown in FIG. 3b is formed by a resilient sheet 76. Obviously the support surfaces may be constructed as desired in each case and may be releasably attached in any suitable manner.

In order to convert a chair into a bed, the arm rest frame, or each arm rest is released from the respective side member of the seat support. The back rest is swung down backwardly and simultaneously the arm rest frame, or each arm rest, is rotated through approximately 180° until the transverse member 15 of the arm rest frame engages the yoke portion 16 of the back support, or each bracket member engages the respective limb of the back support frame, as the case may be, as illustrated in FIG. 2.

In FIG. 4b the chair 1 is provided with a mattress 81 which overlies the back support and the seat support to increase the comfort of the user. The arm rests are also provided with cushions in the form of padded sleeves which are detachably mounted thereon. Instead of a mattress, obviously two cushions may be used. The separate support 70 is also provided with a cushion 83. In FIG. 4b the separate support 70 is frictionally joined to the chair 1, as described above, and the back support is in the lowered position, the mattress 81 and the cushion 83 forming a substantially flat and continuous bed surface.

Owing to the position of the pivot joints 6, 7 and the support surfaces of the back support and the seat support may not be at the same level when the back support is in the swung down extended position. To compensate for the difference in level the mattress may be in two sections of correspondingly different thickness. Alternatively, of course, two cushions of correspondingly different thickness may be used to obtain a continuous flat upper surface.

It is obvious that the chair and the separate support 73 may be provided with a mattress, padded arm rest sleeves, and a cushion or cushions in a similar manner.

The mattress 81, the arm rest sleeves 82, and the cushion or cushions 83 may each comprise an air-tight bag of rubberised or plastics material provided with a valve to permit the bag to be inflated, or the air to be released therefrom. Preferably, however, each consists of a foamed material, such as foam rubber or a suitable foamed synthetic resin, and is enclosed in a detachable protective cover. The cover may be made from any textile fabric, but a material known as stretch fabric is preferred to ensure close fit and improve the appearance. The use of a reversible fabric produced mainly from synthetic resin yarn is also considered.

In order to fold the chair for storage or easy conveyance, the arm rests are released from the respective side members and permitted to drop while at the same time the back support is rotated forward into engagement with the seat support. FIG. 6 illustrates a chair according to FIG. 1 in a nearly completely folded position.

FIG. 5 illustrates diagrammatically how the chair 1 and the separate support 70 can be made collapsible. Whereas in the chair and separate support previously described, each support is made from a single tube, in the present construction each support is made from a plurality of tubular members detachably joined, such as by telescoping, at the locations marked B. In this case the pivotal connections are also arranged to be disconnectable. A chair, and a separate support, constructed in this manner can be assembled and dismantled without the use of tools and can be stored, together with the detachably mounted resilient support members, mattress and cushion or cushions, in an extremely small space.

A bag may be provided for accommodating the foldable chair, a separate support and the respective mattress and cushion or cushions.

In a further modification a table top (not illustrated) consisting of a sheet of rigid material, for example resin bonded glass fibre material, plastics, or wood, may be provided for use with the separate support to form a low table. The underside of the table top may be provided with clips arranged to engage the respective horizontal members of the separate support to secure the table top thereto in a quickly made and quickly released manner.

The chair and the separate support may be constructed from metal tubes consisting for example of steel or aluminium, of from tubes or rods of suitable plastics material which may be reinforced by glass fibres.

FIGS. 7a and 7b show means for securing the arm rests in any one of a plurality of selectable positions. The downwardly directed portion 22 of the arm rest is provided with an inwardly projecting pin 24 with a head 24*a*. The adjacent side member 20 is provided with a latching plate 84 which is generally U-shaped with its two side limbs 84*a*, *b* connected to the side member 20 in offset relationship to each other. The connecting piece 84*c* of the U-shaped plate 84 is disposed outwardly of a vertical plane containing the side member 20 and is turned inwardly at 84*d* to connect with the side limb 84*b*. The connecting piece 84*d* is provided on its upper edge with a plurality of notches 84*e* which are inclined upwardly and forwardly, i.e. in the direction of the foot of the chair. The pin 24 locates in a selected one of said notches 84*e* and can be moved into another notch simply by lifting the arm rest to disengage the pin 24, moving the arm rest to tilt the back portion and then re-introducing the pin 24 into the other notch 84*e*. It will be evident that the opposite side arm preferably has a similar latching arrangement. FIG. 7a shows the arrangement looking in the direction from outside the frame and FIG. 7b is a view in the opposite direction.

What I claim is:

1. A foldable chair comprising three rigid frames, one frame constituting a seat support having front and rear ground supports, a second one constituting a back support and a third one constituting two armrests, the back support frame being pivotally connected to the seat support frame, and the armrests frame being pivotally connected to the back support frame, both pivoting axes being horizontal and parallel to one with the other and spaced apart, and the shape and size of the armrests frame being such that said armrests frame is adapted to be pivoted to pass under said rear ground support of the seat support frame, into a position in which it forms a ground support for the back support frame when the latter is in a swung down extended position to form a bed device, the armrests frame supporting the back support frame when the armrests frame is thus supported on the ground, said armrests frame having a cross piece interconnecting said two armrests and disposed under said seat support frame when said back support frame is raised.

2. A foldable chair as claimed in claim 1 further comprising means for releasably securing the armrests frame to the seat support frame for adjustment of the rake of the back support frame.

3. A foldable chair as claimed in claim 2, wherein said means comprise latching plates provided with a plurality of upwardly and forwardly directed notches and attached to the seat support frame, and cooperating with pins on the armrests frame.

4. A foldable chair as claimed in claim 1 further comprising a separate rigid frame, whose shape and size are such that said separate frame is frictionally and releasably fitted with the seat support frame to form an extension thereof when the chair is used as a bed device.

5. A foldable chair as claimed in claim 1, wherein the frames are of tubular construction.

6. A foldable chair as claimed in claim 1, wherein the pivotal connections are releasable, and wherein the frames are each constructed from bent tubular members some of the ends of which are adapted to be telescoped for quick and easy assembly.

* * * * *